United States Patent [19]

Schank et al.

[11] 3,971,316

[45] July 27, 1976

[54] PROCESS FOR SMOOTHING WATERLESS LITHOGRAPHIC MASTERS

[75] Inventors: Richard L. Schank; Wolfgang H. H. Gunther, both of Webster, N.Y.

[73] Assignee: Xerox Corporation, Stamford, Conn.

[22] Filed: May 28, 1974

[21] Appl. No.: 473,601

[52] U.S. Cl. ..... 101/465; 96/33; 96/36.3; 101/401.1; 101/467; 264/36; 264/278; 427/140; 427/375

[51] Int. Cl.[2] ..... B41N 3/00; B41C 1/10

[58] Field of Search ..... 101/128.2–128.4, 101/455, 463, 466, 467, 470, 471, 395, 401.1, 465, 426; 156/4, 5; 117/6, 35.5, 38, 62.1, 161 ZA, 132 BS; 96/35, 36, 36.2–36.4; 264/36, 322, 278, 283, 293, 284

[56] References Cited

UNITED STATES PATENTS

| | | | |
|---|---|---|---|
| 2,559,539 | 7/1951 | Kelly | 264/36 |
| 2,823,146 | 2/1958 | Roberts et al. | 101/426 X |
| 2,849,752 | 9/1958 | Leary | 101/401.1 |
| 3,063,872 | 11/1962 | Boldebuck | 117/161 ZA |
| 3,215,527 | 11/1965 | Johnson | 101/401.1 |
| 3,221,654 | 12/1965 | Jernt | 101/401.1 |
| 3,273,498 | 9/1966 | Martin | 101/426 |
| 3,362,017 | 1/1968 | Brahm | 346/76 |
| 3,455,239 | 7/1969 | Smith | 101/395 |
| 3,677,178 | 7/1972 | Gipe | 101/460 |

*Primary Examiner*—Clyde I. Coughenour
*Attorney, Agent, or Firm*—James J. Ralabate; James P. O'Sullivan; Donald M. MacKay

[57] ABSTRACT

A method of removing irregularities on the surface of a waterless lithographic master comprising selectively heating an imaged adhesive silicone master, which is deformable at elevated temperature, at a temperature and for a time sufficient to smooth out irregularities in the surface of the master.

11 Claims, 4 Drawing Figures

PROCESS FOR SMOOTHING WATERLESS LITHOGRAPHIC MASTERS

BACKGROUND OF THE INVENTION

It has recently been discovered that the need for a fountain solution on a printing press can be obviated if the master is coated in the non-imaged areas with a silicone elastomer which is ink releasing. A number of difficulties have been encountered, however, with the silicone elastomer masters, sometimes referred to as waterless lithographic masters. For example, by reason of their adhesive or non-adhesive character, it has been difficult to adhere toner particles to the silicone in order to provide an image pattern. While this difficulty can be obviated by impressing an image into the silicone to provide imaged depressions from which prints can be made, it is often found after the silicone is cured, that the non-imaged areas accept ink to a limited extent and that the imaged areas lack clarity both due to irregularities or imperfections in the silicone surface. It is to these problems to which this invention is directed.

BRIEF DESCRIPTION OF THE INVENTION

It has now been discovered that these defects can be obviated to prepare masters of improved clarity and contrast. Further, it has been discovered that damaged masters can be easily repaired or the image removed and the master reimaged to provide reusable masters. More particularly, it has been found that when adhesive waterless lithographic master comprises an abhesive silicone which is deformable at elevated temperature and the image is formed of depressions in the silicone, that the irregularities on the surface of the master can be smoothed out by selectively heating these irregularities. Further, the master can be rendered reusable and the image removed to permit reimaging of the master. If it is desired to repair the master, sharp edges or slight imperfections in the imaged areas can be smoothed out by localized heating. Likewise, imperfections in the non-imaged areas which trap ink can be smoothed out to render the entire non-imaged areas ink releasing. Moreover, prints can be obtained of higher quality than the xerographic document from which it was obtained. In addition, a silicone master which has been rendered ink accepting over its entire surface area, by means of having closely spaced ink accepting depressions formed thereon, may be rendered ink releasing in non-imaged areas while preserving ink acceptance in imaged areas. Other benefits will be apparent from the following detailed description.

DETAILED DESCRIPTION OF THE INVENTION

Figure 1:
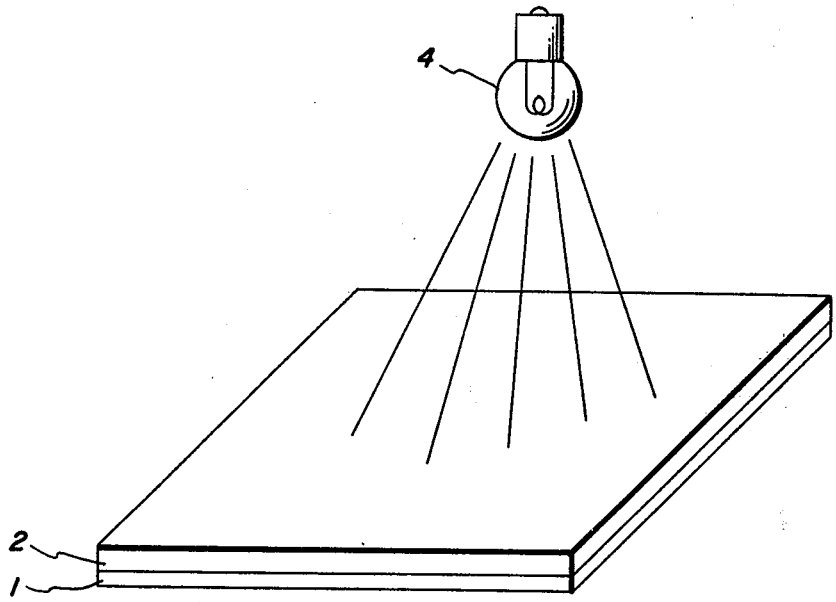
FIG. 1 depicts the non-imaged printing master of the invention.

Suitable master materials, methods of imaging and other aspects of the invention will now be described in detail.

The silicone which can be deposited on a conventional substrate such as paper or aluminum should be a silicone elastomer which is only partially cured and further curable by a means other than heat or, a thermoplastic silicone elastomer can by employed which is not permanently crosslinkable. For example, in the former case, a silicone elastomer having urea, urethane crosslinks or containing a blocked isocyanate which is partially cured by light can be imaged and then the image and/or background areas smoothed out be selectively heating the surface of the elastomer. Then the entire master can be subjected to light to fully cure the elastomer. Preferably, however, a thermoplastic elastomer is employed as the use of same will permit removal of the image and use of the master with a new image.

Exemplary of suitable thermoplastic elastomers are those siloxanes of the formula:

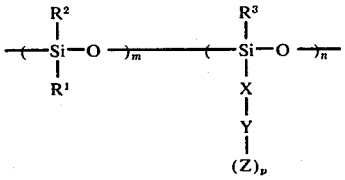

wherein $R^1$, $R^2$ and $R^3$ are independently selected from aryl and alkyl of 1 to 10 carbon atoms; X is a polymethylene chain of from 2 to 10 carbon atoms; Y is a group selected from ureido, silylureido, amido, silylamino, thioureido, silylthioureido, urethano, alkylideneamino, isocyanoureido, halosilylamino and sulfonamido; Z is a hydrocarbon of from 1 to 50 carbon atoms selected from alkyl, alkaryl, aryl, aralkyl which hydrocarbon can be substituted with one or more groups selected from hydroxy, nitro, halo, sulfonamido and carboxyl; *m* and *n* are integers wherein the ratio of *m:n* is between 20:1 and 1000:1, and *p* is an integer of from 1 to 3. These elastomers which are prepared by reacting a silicone gum having reactive pendant groups with monofunctional compounds to cap the pendant groups, surprisingly have elastomeric properties although there is no chemical crosslinking through said pendant groups. Further, because they are not crosslinked, they can be dissolved in a hydrocarbon or other solvent and reformed into a non-imaged master. Examples of suitable compounds and methods for preparing same are disclosed in U.S. Patent application Ser. No. 420,751, which reference is herein incorporated by reference in its entirety.

Other thermoplastic silicones which can be employed are simple and multiple block copolymers having a silicone phase such as polydimethylsiloxane and a thermoplastic non-silicone phase such as polystyrene, polyesters, polyamides, acrylics, vinyl polymers and polyurethanes. These polyblock or heterophase compositions are elastomeric in character without chemical crosslinking because the segments of the molecule which are non-silicone have a glass transition temperature of at least about ambient temperature which associate with one another. These hard segments form physical crosslinks which do not allow entire polymer chains to flow past one another although the soft segments can elongate, thus imparting elastomeric properties to the materials. Ink releasable heterophase polymeric compositions which normally have a ratio by weight of between about 95 to 50 parts of the silicone phase to 5 to 50 parts of non-silicone polymer are disclosed in U.S. Pat. application Ser. No. 351,111, which is herein incorporated by reference in its entirety. Elastomeric block copolymers of silicones and styrene are disclosed in U.S. Pat. No. 3,760,030, filed in the name of John Dean.

Exemplary of suitable organic polysiloxanes which can be cured by means of light or electron beams are described in German OLS No. 2,207,495, which is herein incorporated by reference in its entirety. Polymers disclosed therein are derived from at least one organopolysiloxane such as polydimethylsiloxane with an unsaturated residue of the following structure:

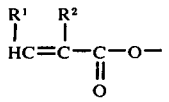

wherein $R^1$ can be hydrogen or a halogen substituted phenyl residue while $R^2$ is hydrogen or a methyl residue. The unsaturated side chain may be based on acryloxy, methacryloxy, cinnamoyloxy, or halogenated cinnamoyloxy residues. An inhibitor to thermal polymerization as well as a sensitizer to specific electromagnetic radiation can be incorporated therein.

Although the above silicones have been described by the use of polydimethylsiloxane as the silicone backbone, other silicones can be employed such as those having both methyl and phenyl containing groups in the polymer chain as well as gums having both methyl and vinyl groups, methyl and flouorine groups, or methyl, phenyl and vinyl groups in the polymer chain.

A number of means can be employed to image the masters. For example, a preferred method of imaging involves the basic xerographic process which comprises depositing a uniform electrostatic charge on a photoconductive insulating layer, exposing the layer to a light and shadow image to dissipate the charge on the areas of the layer exposed to the light and developing the resultant electrostatic latent image by depositing on the image, a finely-divided electroscopic imaging material referred to in the art as "toner." The conventional toners can be employed which typically are thermoplastic materials such as polymers of styrene, vinyl chloride and like in combination with a pigment such as carbon black. Exemplary of suitable styrene polymers are polystyrene, styrene n-butylmethacrylate copolymer and styrene-butadiene copolymer. The image can be developed on a separate photoconductive surface and transferred to the silicone by electrostatic transfer or similar means, or by employing a photoconductive substrate, the image can be formed and developed on the silicone. By depositing the toner on a tacky uncured silicone or on one which is only partially cured so that the toner can be partially embedded therein, the master can be fully cured, the toner removed with a suitable solvent such as acetone to reveal image depressions which are ink accepting and the master heated to smooth the irregularities in the image and non-image areas. Alternatively, the master can be subjected to a heating step to smooth out the irregularities in the non-imaged areas prior to removing the toner in the imaged areas.

A preferred method of imaging is to form a master in which the entire surface area is composed of closely spaced depressions adapted to form an imaged area. These depressions can be formed by depositing an inorganic salt (e.g. magnesium sulfate or sodium chloride) or finely divided toner on an uncured tacky silicone, the silicone cured to a non-tacky condition and the salt or toner removed by washing with water or a suitable solvent. The master can then be stored until it is imaged by depositing an adhesive silicone gum in image configuration to fill the depressions surrounding the imaged areas so as to permit printing from the remaining imagewise depressions. Instead of depositing a particulate material on the plate, depressions may be impressed in the plate by use of a mold having a release agent coated thereon, the silicone partially cured and then the plate removed from the mold. Further, by the use of a silicone which is deformable by heat, a plate having depressions over its entire surface can be imaged by depositing a particulate material such as toner in image configuration and collapsing the depressions in the non-imaged areas by gently heating said non-imaged areas. Then the particulate material can be removed to reveal the imaged depressions. Further, using a silicone which is both deformable by heat and curable by light, a plate having ink accepting depressions over its entire surface may be imaged by first imagewise irradiating areas where it is desirous that ink acceptance be retained. Background areas may then be thermally collapsed to form a smooth, ink rejecting surface which may then be further cured by general illumination of the entire structure. Other methods of forming ink accepting depressions in the adhesive silicone will be apparent to one having ordinary skill in the art.

The elevated temperature at which the silicone can be deformed to smooth out irregularities in the surface of the silicone will depend upon its type, thickness, the type of master substrate and the like. For example, masters having paper substrates cannot be heated to as high a temperature as masters having aluminum substrates. Further, since the silicone may contain, for example, links such as urethane, urea or be composed of polyblocks in which one of the links is a thermoplastic polymer, the temperature employed will depend upon the particular link destroyed or material employed. The particular softening temperature, however, can be easily empirically determined but generally will be between about 50° and about 450°C, and preferably between about 150° and about 300°C.

Figure 2:
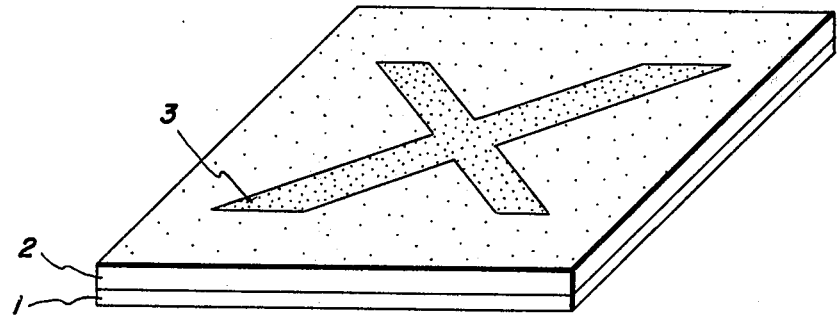
FIG. 2 depicts the imaged printing master of the invention.
Figure 3:
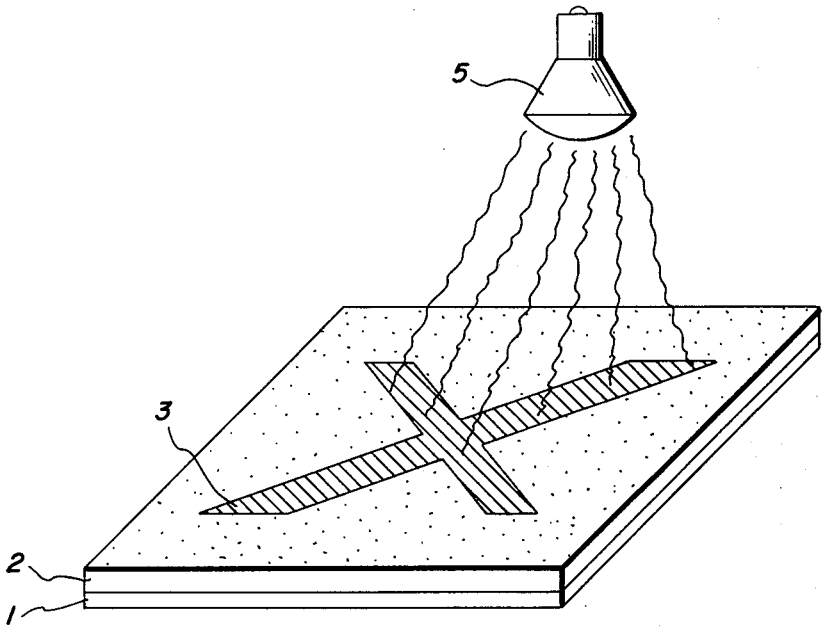
FIG. 3 depicts the imaged printing master of the invention with a particulate material deposited in imaged depressions to protect the imaged areas during the heat treatment.
Figure 4:
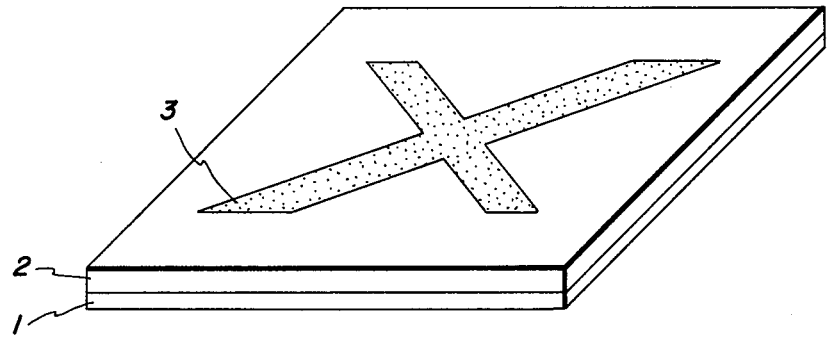
FIG. 4 depicts the imaged printing master of the invention after the particulate material has been removed from the imaged depressions and irregularities removed from the non-imaged areas.

Referring now to the drawings and specifically FIG. 1, the printing master comprises a suitable substrate 1 which is a self-supporting material such as metal, plastic or the like. The substrate is coated with an adhesive silicone which is curable by activating electromagnetic radiation to an ink releasing condition and the silicone is cured by light 4. In FIG. 2 the master is depicted with an image 3 and in FIG. 3 the imaged master is covered with a particulate material in the imaged areas to protect the imaged areas during the heat treatment provided by lamp 5. In FIG. 4 the imaged printing master is shown with the particulate material removed from the imaged areas and it can be seen that the irregularities in the non-imaged areas depicted in FIG. 2 are now removed.

The following examples are illustrative of the invention and preferred embodiments. All parts and percentages in said examples and elsewhere in the specification and claims are by weight unless otherwise specified.

EXAMPLE I

A printing master was prepared as follows. Thirty grams of a 10 weight percent solution of poly (dimethyl siloxane) silicone gum (Union Carbide Y-3557) in benzene (which has 0.5 weight percent of aminobutylmethylsiloxane pendant sites and a molecular weight from 200,000 to 500,000) was mixed with 0.04 gram of dimethyl dichlorosilane (capping agent in an amount excess to the pendant amino groups of the silicone gum) and blended by stirring in an open beaker. To this mixture was added 0.6 gram of a 5 weight percent solution in tetrahydrofuran of the acetone oxime adduct of toluene-2,4-diisocyanate. The resultant solution was draw bar coated on a 10 × 15 inch aluminum sheet. The solvent was allowed to evaporate by maintaining the coated sheet at room temperature for 1 hour and the coating was found to be dry to the touch resembling an elastomeric polymer rather than a gum. The thickness of the film when dry was between 6 and 8 microns.

Thereafter using a Xerox Model D processor, an electrostatic latent test image was formed and cascade developed with Xerox 2400 toner, after which the developed image was electrostatically transferred to the surface of the coated sheet. The sheet was then placed in a Xerox vapor fuser containing air saturated with ethyl alcohol and then maintained therein at room temperature for a period of one minute. The sheet was then removed from the vapor fuser and placed in an air oven maintained at 175°C and placed in intimate contact with a metal shelf of the oven. After a period of 5 minutes, the sheet was removed from the oven and allowed to cool to room temperature. The silicone coating was found to have been converted to a tough highly elastomeric polymer and the toner image was found to have become bonded to the silicone polymer as the toner could not be removed by adhesive tape. The sheet was then washed with acetone to remove the toner. The master sheet was then cut into two pieces, one piece inked and prints made therefrom. Clear sharp images were obtained but there was some undesirable background density. The second piece was heated for 30 seconds on a hot plate at 800°F, allowed to cool to room temperature, and prints made from it. The prints were of excellent quality, with no appreciable background density, and of better quality than the xerographic image from which it was derived.

EXAMPLE II

In accordance with the general procedure of Example I, a printing master is prepared and excellent prints made therefrom employing a paper master substrate (A. B. Dick 3000) and a polydimethylsiloxane having pendant butylnaphthylureido sites.

EXAMPLE III

In accordance with the general procedure of Example I, a printing master is prepared and excellent prints made therefrom employing a polydimethylsiloxane elastomer having pendant butyltriphenylsilylimino groups.

EXAMPLE IV

In accordance with the general procedure of Example I, the silicone gum of Example I is coated on an aluminum substrate and while tacky, sodium chloride having a particle size range of between 5 and 30 microns is spread over the entire uncured silicone to provide a height of about 10 microns and the silicone cured by placing the sheet in an air oven at 175°C for 15 minutes. The sheet is then allowed to cool to room temperature and the salt removed by washing the plate with water to reveal closely spaced depressions over the surface of the plate. The plate is then imaged with particulate toner and subjected to a heat treatment in accordance with the procedure of Example I to collapse the depressions in the non-imaged areas and form a smooth ink releasing surface. The plate is then washed with acetone to remove the particulate toner, attached to a Davidson Duo Lithographic printing press inked with Van Son 10850 rubber based ink and excellent prints obtained therefrom.

EXAMPLE V

A block copolymer of 50% by weight polydimethylsiloxane and 50% polystyrene is blended with an equal amount of an organopolysiloxane prepared from acryloxypropyltrichlorosilane and dihydroxydimethylsilicone comprising 0.5 weight percent hydroquinone sensitizer. The mixture is dissolved in toluene and coated onto a degreased aluminum plate to a thickness of 8 to 10 microns when dried. The plate is dried for 10 minutes at 80°C to evaporate the solvent and then passed through a heated form roller having closely spaced projections thereon so as to impress ink accepting depressions into the entire silicone plate. The plate is then cooled to room temperature and stored in the dark. The plate is imaged by placing a negative transparency thereon and exposing to a xenon lamp of 3,000 watts, 50 centimeters from the plate, for a period of 2 to 4 minutes. The plate is then passed over a heated roller with the imaged face exposed whereby the plate is heated to 180°C. It is noted that the background of silicone becomes soft and fluid such that it forms a smooth surface while the crosslinked image structure remains unaffected by this treatment. The plate is then permanently crosslinked by subjecting it to a high intensity lamp at short distance followed by mounting on a Davidson Duo lithographic printing press. Prints of excellent quality are obtained much superior to those obtained from the master which has not had the intermediate heating step.

EXAMPLE VI

A master is prepared in accordance with the procedure in Example V but the plate is imaged by subjecting image areas to a scanning U.V. light beam so as to stabilize the ink accepting depressions. The plate is then subjected to a heating step to smooth the background areas followed by illumination of the entire plate with intense U.V. light and mounting on a printing press. Prints of excellent quality are obtained.

EXAMPLE VII

The procedure of Example V is repeated but for the exception that an electron beam is employed to cure the imagewise depressions in the silicone.

EXAMPLE VIII

In accordance with the procedure of Example I, a silicone gun is coated on an aluminum substrate and closely spaced depressions formed over the entire surface with a mold having a release coating thereon. The silicone is then fully cured by heat, and a finely divided particulate toner comprising a copolymer of styrene and n-butyl methacrylate deposited thereon in image configuration. An aqueous emulsion of polydimethylsiloxane gum is applied to the plate so as to fill the non-imaged depressions. The plate is then subjected to a gentle heating step to evaporate the water in the gum and smooth surface irregularities in the non-imaged area. The plate is then fully cured at elevated temperature followed by removal of the toner from the imaged areas by washing with acetone and mounting of the plate on a printing press. Copies of excellent quality are obtained.

EXAMLE IX

A printing master is prepared and imaged in accordance with the procedure in Example I. After the toner is removed selected image portions are collapsed and erased by the application of a direct infra-red beam. The plate is then fully cured.

EXAMPLE X

A master is prepared by depositing the polydimethylsiloxane gum of Example I on an aluminum substrate and depressions formed over its entire surface by the use of a mold having a release coating thereon. The plate is cured by heat and the entire plate coated with the photocrosslinkable composition of Example V to fill the depressions. The plate is then exposed to activating electromagnetic radiation in the background areas followed by washing with a solvent to remove the uncrosslinked silicone to reveal imagewise depressions. The plate is mounted on a printing press and excellent prints are obtained despite the fact that the imaged depressions are formed of an ink-releasing silicone.

Having described the present invention with reference to these specific embodiments, it is to be understood that numerous variations may be made without departing from the spirit of the present invention and it is intended to encompass such reasonable variations or equivalents within its scope.

What is claimed is:

1. A method of removing irregularities on the surface of a waterless lithographic master comprising providing a waterless lithographic master comprising an adhesive silicone which is deformable at elevated temperature and having an image formed of depressions in the silicone, said master additionally having surface irregularities in the non-imaged areas which accept ink or surface irregularities in the imaged areas resulting in a lack of clarity; selectively heating said master at a temperature and for a time sufficient to smooth out said irregularities without collapsing the image.

2. The method of claim 1 wherein a particulate material is deposited in said imaged depressions to protect the imaged areas during the heat treatment.

3. The method of claim 2 wherein the particulate material is relatively insensitive to heat.

4. The method of claim 1 wherein the master comprises a silicone formed of a gum having reactive pendant groups capped with monofunctional compounds.

5. The method of claim 1 wherein the master comprises a silicone which can be cured by light.

6. A method of preparing a waterless lithographic master comprising providing a suitable master substrate and a silicone which is curable by electromagnetic activating radiation to an adhesive condition and deformable by heat or mechanical application, depositing said silicone on said substrate, mechanically deforming said silicone by generating ink accepting depressions therein, curing said silicone in an imagewise configuration by the application of activating electromagnetic radiation, heating said silicone to smooth out deformations in the non-imaged areas without collapsing the image, and subjecting said silicone to activating electromagnetic radiation to fully cure the silicone to an adhesive condition.

7. A method of preparing a waterless lithographic printing master comprising providing a printing master having a surface layer of a silicone curable by activating electromagnetic radiation to an adhesive condition and softenable by heat, and having closely spaced depressions sufficient to trap printing ink and permit an image to be formed therein, imagewise curing said master by activating electromagnetic radiation, heating the depressions to selectively collapse said depressions and form a relatively level non-imaged area, and subjecting said non-imaged area to activating electromagnetic radiation to cure said area to an adhesive ink releasing condition.

8. The process of claim 7 wherein the master comprises a photocrosslinkable silicone which is imagewise cured prior to collapsing the non-imaged areas.

9. The process of claim 8 wherein the master is imaged by a scanning light beam.

10. The process of claim 8 wherein the master is imaged with an electron beam.

11. The process of claim 7 wherein a particulate material is deposited in imagewise configuration prior to collapsing the non-imaged areas and the particulate material removed after the non-imaged areas are collapsed.

* * * * *

UNITED STATES PATENT AND TRADEMARK OFFICE

CERTIFICATE OF CORRECTION

PATENT NO. : 3,971,316

DATED : July 27, 1976

INVENTOR(S) : Richard L. Schank and Wolfgang H. H. Gunther

It is certified that error appears in the above-identified patent and that said Letters Patent are hereby corrected as shown below:

In the Abstract, line 3, "adhesive" should be --abhesive--.

Column 1, line 14, "adhesive" (first occurrence) should be --abhesive--.

Column 1, line 32, after "when" delete "adhesive" and insert --the--.

Column 3, line 53, after "and" insert --the--.

Column 4, lines 14, 36 and 57 "adhesive" should be --abhesive--.

Column 7, line 2, "gun" should be --gum--.

Column 7, line 51, "adhesive" should be --abhesive--.

Column 8, lines 19, 34 and 41, "adhesive" should be --abhesive--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*